US006615913B1

(12) United States Patent
Hugg et al.

(10) Patent No.: US 6,615,913 B1
(45) Date of Patent: Sep. 9, 2003

(54) PYROMETALLURGICAL REACTOR COOLING ELEMENT AND ITS MANUFACTURE

(75) Inventors: Eero Hugg, Espoo (FI); Ilkka Kojo, Kirkkonummi (FI); Pertti Mäkinen, Pori (FI); Raimo Koota, Nakkila (FI)

(73) Assignee: Outokumpu Oyj, Espoo (FI)

( * ) Notice: Subject to any disclaimer, the term of this patent is extended or adjusted under 35 U.S.C. 154(b) by 0 days.

(21) Appl. No.: 09/868,287

(22) PCT Filed: Dec. 14, 1999

(86) PCT No.: PCT/FI99/01030

§ 371 (c)(1),
(2), (4) Date: Jun. 15, 2001

(87) PCT Pub. No.: WO00/37871

PCT Pub. Date: Jun. 29, 2000

(30) Foreign Application Priority Data

Dec. 22, 1998 (FI) ..... 982770

(51) Int. Cl.[7] ..... F28F 19/02

(52) U.S. Cl. ..... 165/133; 165/905; 165/179; 29/890.03; 29/890.053; 164/98; 164/132; 428/137

(58) Field of Search ..... 165/133, 905; 29/890.053, 890.03; 428/137; 164/98, 132

(56) References Cited

U.S. PATENT DOCUMENTS

| | | | | | |
|---|---|---|---|---|---|
| 3,906,605 | A | * | 9/1975 | McLain | 29/890.053 |
| 4,058,394 | A | * | 11/1977 | Crimes | 75/61 |
| 4,677,724 | A | * | 7/1987 | Kuroki | 29/890.053 |
| 4,838,346 | A | * | 6/1989 | Camarda et al. | 165/104.14 |
| 4,995,252 | A | * | 2/1991 | Robertson et al. | 72/194 |
| 5,051,146 | A | * | 9/1991 | Kapolnek et al. | 29/890.053 |
| 5,687,604 | A | * | 11/1997 | Robbins | 72/265 |
| 5,775,402 | A | * | 7/1998 | Sachs et al. | 164/4.1 |
| 5,875,830 | A | * | 3/1999 | Singer et al. | 164/19 |
| 5,895,561 | A | * | 4/1999 | George | 205/114 |
| 5,933,953 | A | * | 8/1999 | Spencer et al. | 29/890.053 |
| 6,134,785 | A | * | 10/2000 | Walter et al. | 29/890.054 |

FOREIGN PATENT DOCUMENTS

| | | |
|---|---|---|
| EP | 0 893 509 A1 | 6/1998 |
| GB | 1386645 | 3/1975 |
| JP | 1 009 9913 | 6/1998 |

* cited by examiner

*Primary Examiner*—Henry Bennett
*Assistant Examiner*—Terrell McKinnon
(74) *Attorney, Agent, or Firm*—Morgan & Finnegan, LLP

(57) ABSTRACT

The invention relates to a method of fabricating a pyrometallurgical reactor cooling element with flow channels. In order to enhance heat transfer capability, the wall surface area of the flow channel, which is traditionally round in cross-section, is increased without increasing the diameter or length of the channel.

5 Claims, 8 Drawing Sheets

PYROMETALLURGICAL REACTOR COOLING ELEMENT AND ITS MANUFACTURE

FIELD OF THE INVENTION

The present invention relates to a method of manufacturing a cooling element with flow channels for pyrometallurgical reactors. In order to enhance the heat transfer capability of the element, the surface area of the flow channel wall, which is traditionally round in cross-section, is increased without increasing the diameter or length of the flow channel. The invention also relates to the element manufactured by this method.

BACKGROUND OF THE INVENTION

The refractory of reactors in pyrometallurgical processes is protected by water-cooled cooling elements so that, as a result of cooling, the heat coming to the refractory surface is transferred via the cooling element to water, whereby the wear on the lining is significantly reduced compared with a reactor which is not cooled. Reduced wear is caused by the effect of cooling, which brings about forming of so called autogenic lining, which fixes to the surface of the heat resistant lining and which is formed from slag and other substances precipitated from the molten phases.

Conventionally cooling elements are manufactured in two ways: primarily, elements can be manufactured by sand casting, where cooling pipes made of a highly thermal conductive material such as copper are set in a sand-formed mould, and are cooled with air or water during the casting around the pipes. The element cast around the pipes is also of highly thermal conductive material, preferably copper. This kind of manufacturing method is described in e.g. GB patent no. 1386645. One problem with this method is the uneven attachment of the piping acting as cooling channel to the cast material surrounding it. Some of the pipes may be completely free of the element cast around it and part of the pipe may be completely melted and thus fused with the element. If no metallic bond is formed between the cooling pipe and the rest of the cast element around it, heat transfer will not be efficient. Again if the piping melts completely, that will prevent the flow of cooling water. The casting properties of the cast material can be improved, for example, by mixing phosphorus with the copper to improve the metallic bond formed between the piping and the cast material, but in that case, the heat transfer properties (thermal conductivity) of the copper are significantly weakened by even a small addition. One advantage of this method worth mentioning is the comparatively low manufacturing cost and independence from dimensions.

Another method of manufacture is used, whereby glass tubing in the shape of a channel is set into the cooling element mould, which is broken after casting to form a channel inside the element.

U.S. Pat. No. 4,382,585 describes another much used method of manufacturing cooling elements, according to which the element is manufactured for example from rolled or forged copper plate by machining the necessary channels into it. The advantage of an element manufactured this way, is its dense, strong structure and good heat transfer from the element to a cooling medium such as water. Its disadvantages are dimensional limitations (size) and high cost.

The ability of a cooling element to receive heat can be presented by means of the following formula:

$Q=\alpha\times A\times\Delta T$, where

Q=amount of heat being transferred [W]

$\alpha$=heat transfer coefficient between flow channel wall and water [W/Km$^2$]

A=heat transfer surface area [m$^2$]

$\Delta T$=difference in temperature between flow channel wall and water [K]

Heat transfer coefficient a can be determined theoretically from the formula $$Nu=\alpha D/\lambda$$

$\lambda$=thermal conductivity of water [W/mK]

D =hydraulic diameter [m]

Or $Nu=0.023\times Re\hat{}0.8Pr\hat{}0.4$, where $Re=wD\rho l\eta$ w=speed [m/s]

D=hydraulic diameter of channel [m]

$\rho$=density of water [kg/m$^3$]

$\eta$=dynamic viscosity

Pr=Prandtl number [ ]

Thus, according to the above, it is possible to influence the amount of heat transferred in a cooling element by influencing the difference in temperature, the heat transfer coefficient or the heat transfer surface area.

The difference in temperature between the wall and the tube is limited by the fact that water boils at 100° C., when the heat transfer properties at normal pressure become significantly worse due to boiling. In practice, it is more advantageous to operate at the lowest possible flow channel wall temperature.

The heat transfer coefficient can be influenced largely by changing the flow speed, i.e. by affecting the Reynolds number. This is limited however by the increased loss in pressure in the tubing as the flow rate increases, which raises the costs of pumping the cooling water and pump investment costs also grow considerably after a certain limit is exceeded.

In a conventional solution, the heat transfer surface area can be influenced either by increasing the diameter of the cooling channel and/or its length.

The cooling channel diameter cannot be increased unrestrictedly in such a way as to be still economically viable, since an increase in channel diameter increases the amount of water required to achieve a certain flow rate and furthermore, the energy requirement for pumping. On the, other hand, the channel diameter is limited by the physical size of the cooling element, which for reasons of minimizing investment costs, is preferably made as small and light as possible. Another limitation on length is the physical size of the cooling element itself, i.e. the quantity of cooling channel that will fit in a given area.

SUMMARY OF THE INVENTION

The present invention relates to a method of manufacturing a cooling element for a pyrometallurgical reactor from a highly thermal conductive metal such as copper, in which the heat transfer capability of said cooling element is enhanced significantly by increasing heat transfer surface area so that it is economically feasible to manufacture a thinner cooling element. This is done so that the wall surface area of the flow channel is increased without increasing the diameter of the cooling channel or adding length. The surface of the flow channel in the cooling element, which is essentially round in cross-section, is enlarged by forming grooves or threads on the inner surface of the channel, by means of subsequent machining. As a result, a smaller temperature difference is required between the water and the cooling channel wall with the same amount of heat, and furthermore, a lower cooling element temperature. The invention also relates to the cooling element manufactured by this method. The essential features will become apparent in the attached patent claims.

In the cooling element described in the present invention, the heat transfer surface area is increased so that, although the cooling element flow channel is basically round in cross-section, its wall is not smooth, but by changing the contour of the wall very slightly, a greater heat transfer surface area can be achieved with the same flow cross-sectional area (the same rate can be achieved with the same amount of water) compared with the unit of length of the cooling channel. This increase in surface area can be achieved in the following ways:

A cooling element, manufactured by working, e.g. by rolling or forging, into which at least one flow channel which is round in cross-section is machined for example by drilling, threads are machined afterwards on the inner surface of the flow channel. The cross-section of the channel remains essentially round.

A cooling element, manufactured by working, into which at least one flow channel, which is round in cross-section is machined, rifle-like grooves are machined afterwards on the inner surface of the flow channel. The cross-section of the channel remains essentially round.

Rifle-like grooves can be obtained advantageously by using a so-called expanding mandrel, which is drawn through the flow channel. The grooving can be made for instance to a hole, closed at one end, in which case the mandrel is pulled outwards. A hole can be made into a channel, which is open at both ends either, by pushing or drawing a purpose-designed tool through the channel.

It is evident in all the methods described above that, if there are transverse channel parts in the flow channel, seen from the casting direction, these parts are made mechanically by machining e.g. drilling, and the holes which do not belong to the channel are plugged. The benefit of the method described in this invention was compared with prior art by using the attached example.

BRIEF DESCRIPTION OF THE DRAWINGS

With the example are some diagrams to illustrate the invention, wherein.

DETAILED DESCRIPTION OF THE INVENTION

EXAMPLE

The cooling elements relating to the present invention were tested in practical tests, where the bottom of said elements A,B,C and D were immersed in about 1 cm deep molten lead. Cooling element A had a conventional smooth-surfaced flow channel, and this element was used for comparative measurements. The amount of cooling water and the temperatures both before feeding the water into the cooling element and afterwards were carefully measured in the tests. The temperature of the molten lead and the temperatures inside the cooling element itself were also carefully measured at seven different measuring points.

Figure 1:
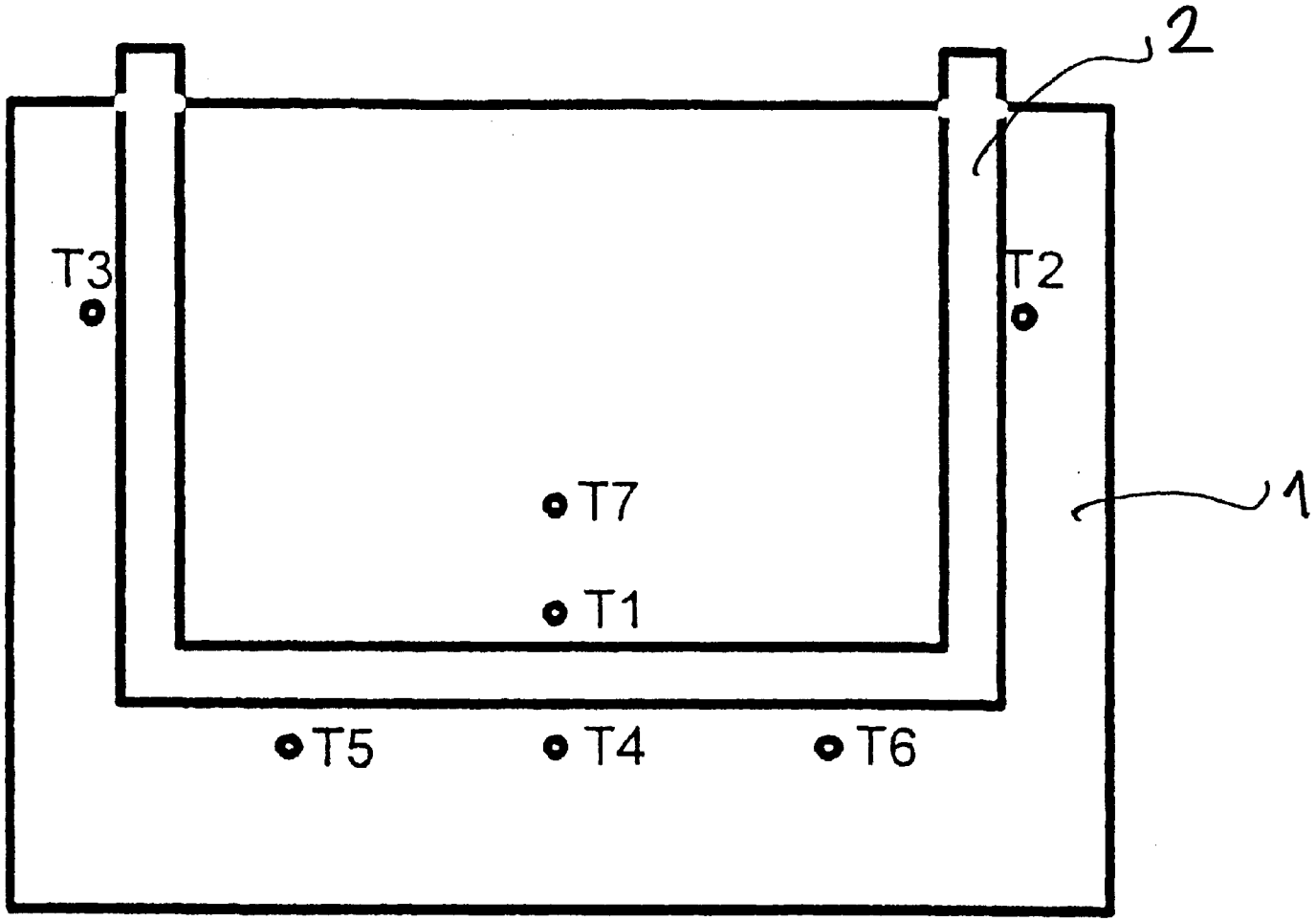
FIG. 1 shows a principle drawing of the cooling element used in the tests.
Figure 2:
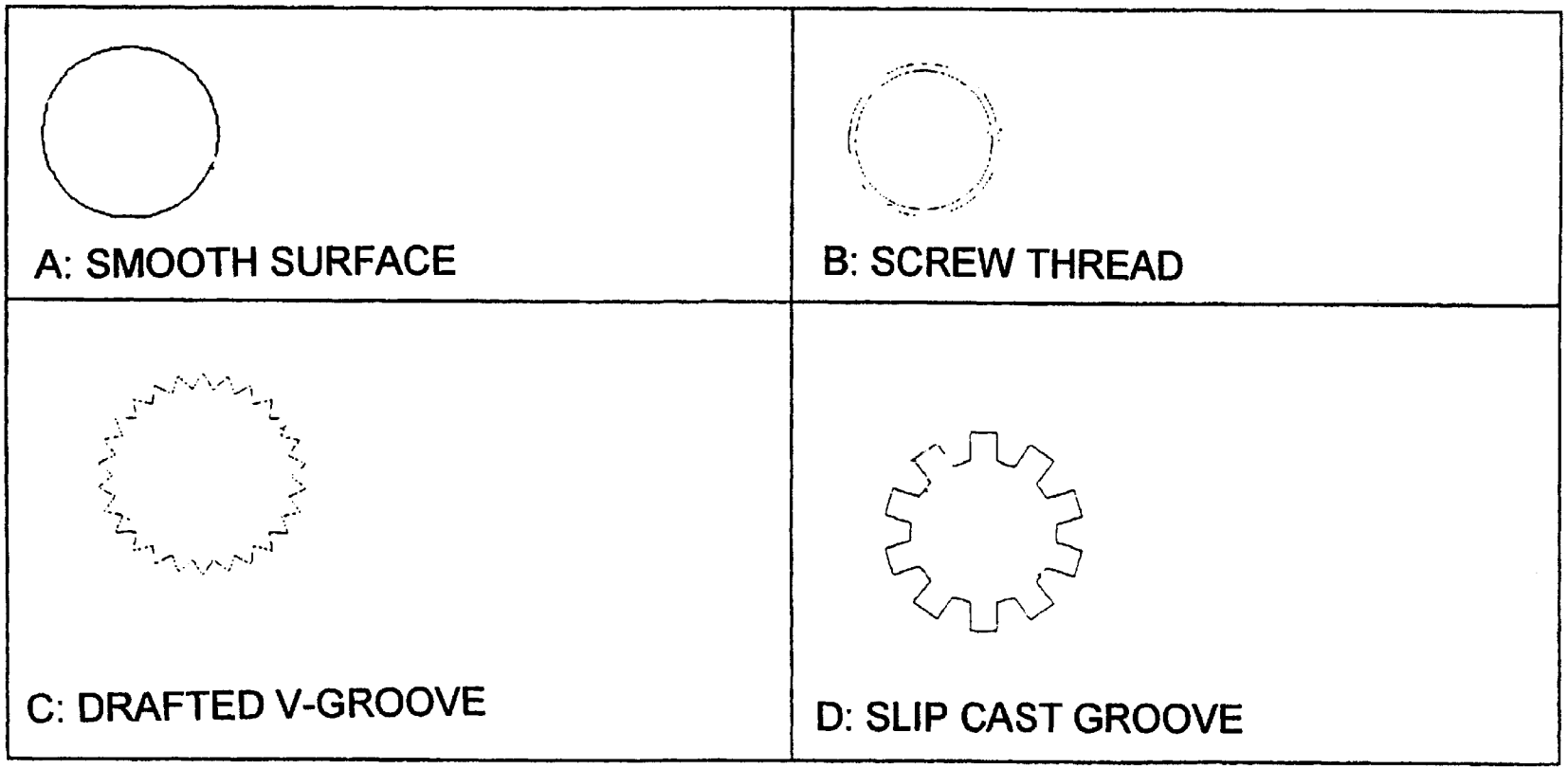
FIG. 2 shows a cross-sectional profile of the test cooling element.
Figure 3A:
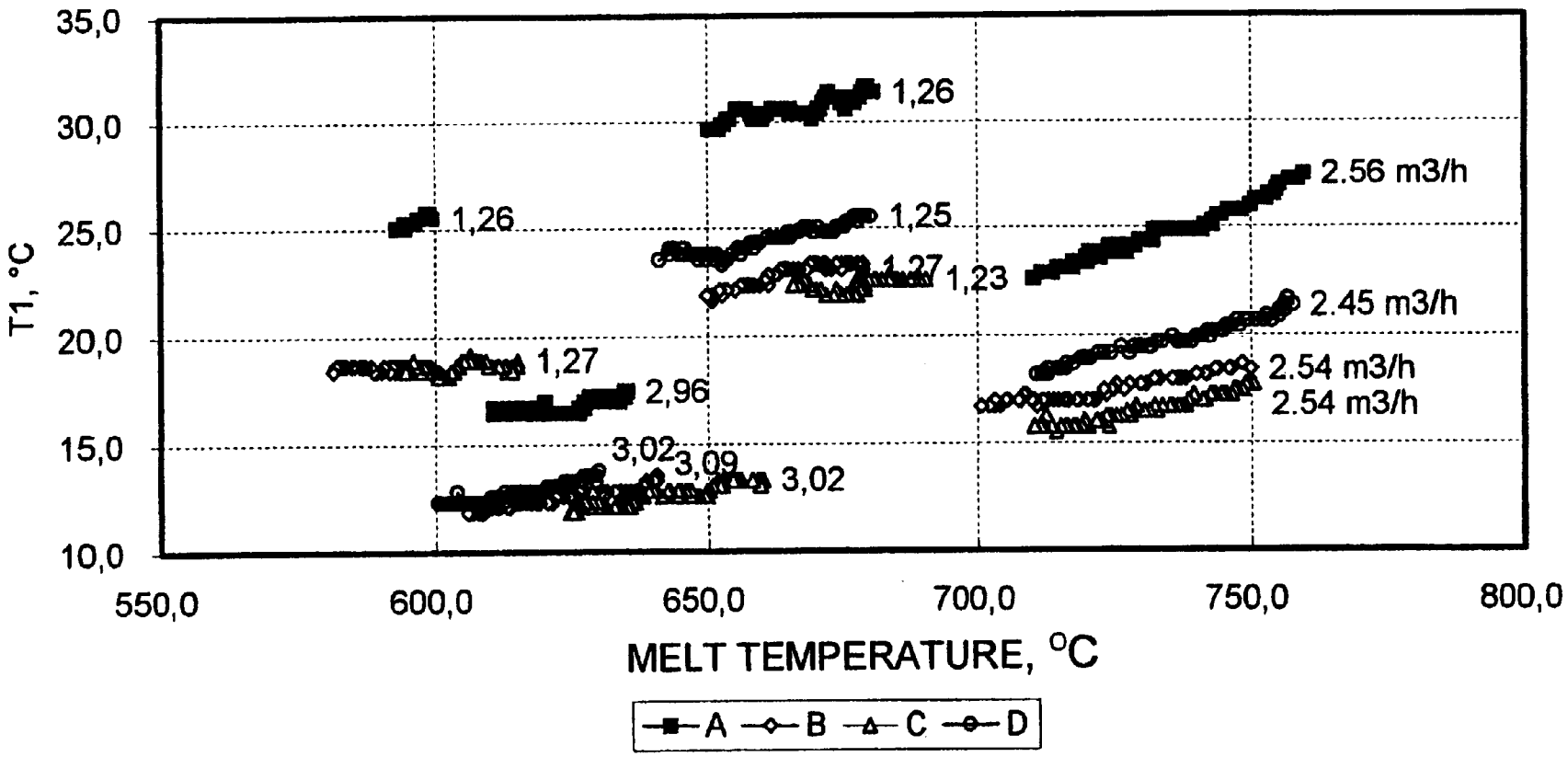
FIGS. 3*a*–3*d* indicate the temperature inside the element at different measuring points as a function of melt temperature.
Figure 3B:
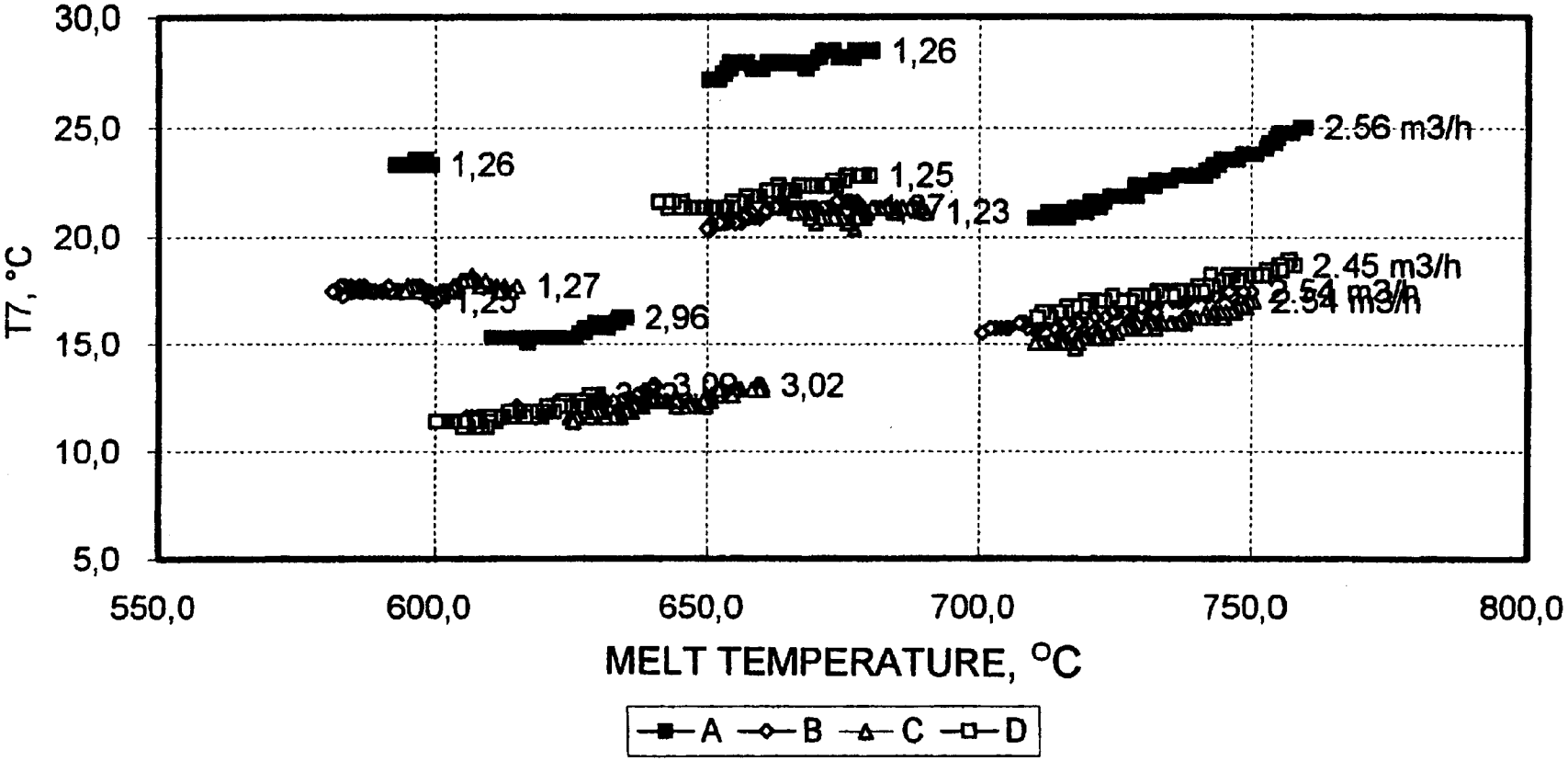
Figure 3C:
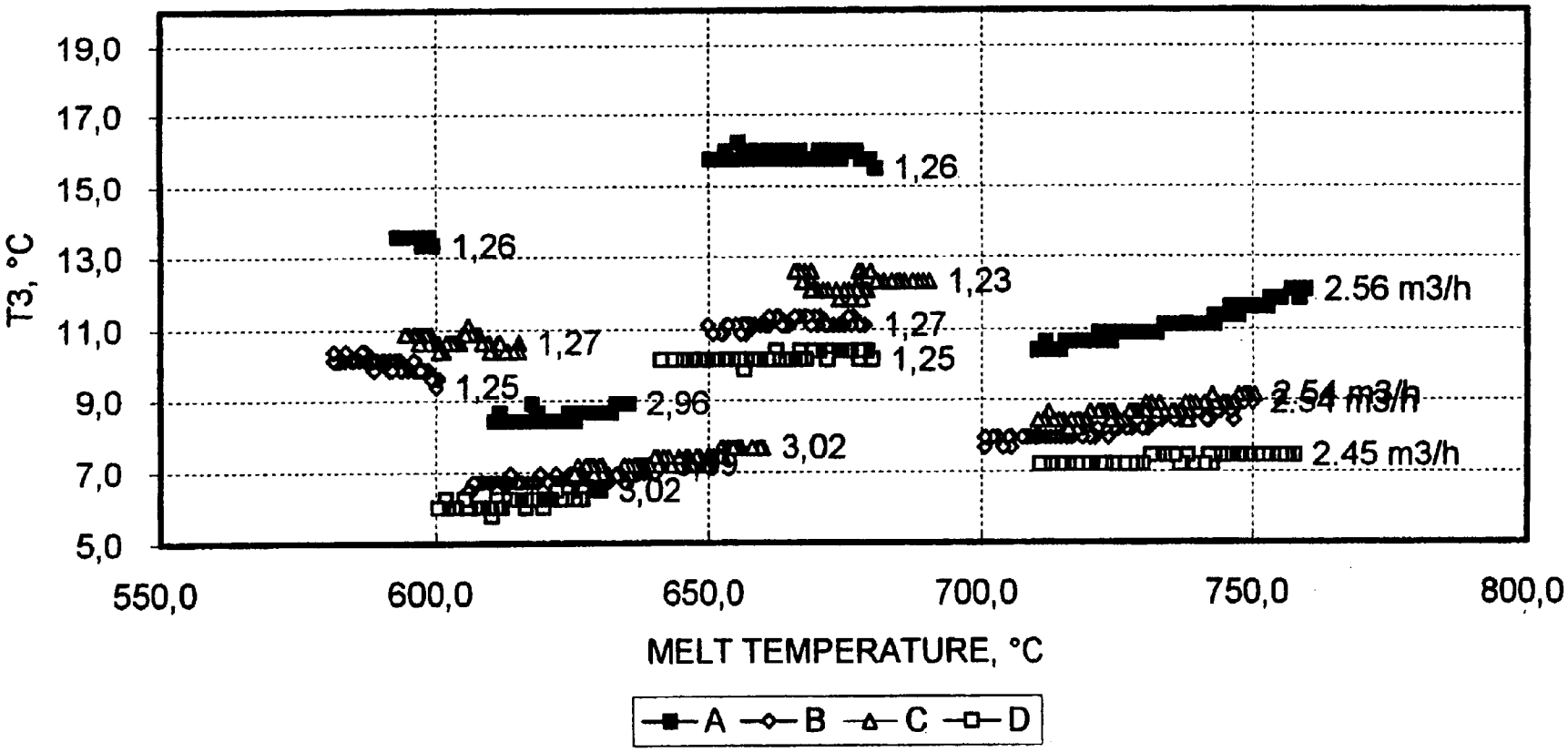
Figure 3D:
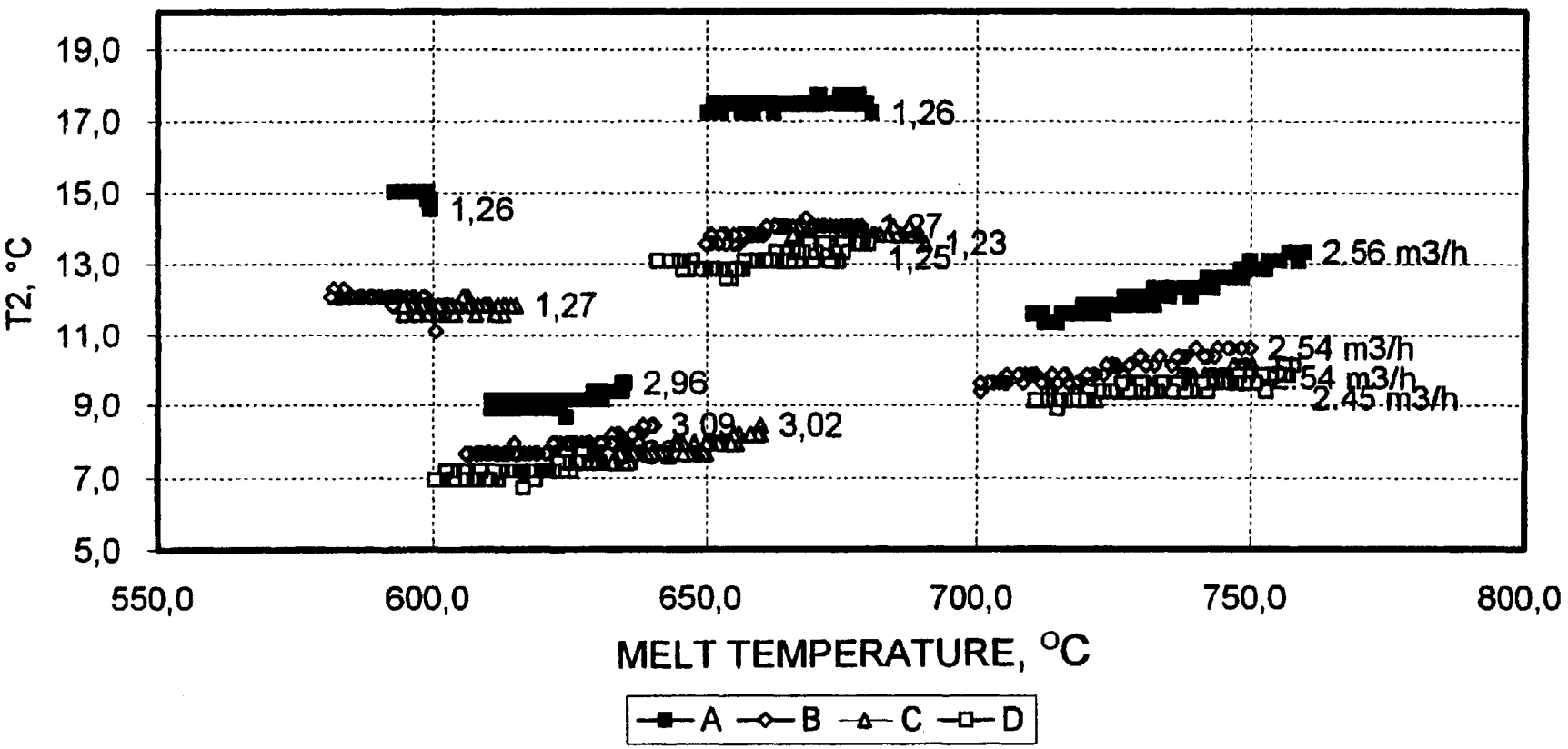

FIG. 1 shows the cooling element 1 used in the tests, and the flow channel 2 inside it. The dimensions of the cooling element were as follows: height 300 mm, width 400 mm and thickness 75 mm. The cooling tube or flow channel was situated inside the element as in FIG. 1, so, that the centre of the horizontal part of the tube in the figure was 87 mm from the bottom of the element and each vertical piece was 50 mm from the edge of the plate. The horizontal part of the tube is made by drilling, and one end of the horizontal opening is plugged (not shown in detail). FIG. 1 also shows the location of temperature measuring points T1–T7. FIG. 2 presents the surface shape of the cooling channels and Table 1 contains the dimensions of the test cooling element channels and the calculatory heat transfer surfaces per meter as well as the relative heat transfer surfaces.

TABLE 1

| | Diameter mm | Flow cross-sectional area $mm^2$ | Heat transfer surface/1 m $m^2$/1 m | Relative heat transfer surface area |
|---|---|---|---|---|
| A | 21.0 | 346 | 0.066 | 1.00 |
| B | 23.0 | 415 | 0.095 | 1.44 |
| C | 23.0 | 484 | 0.127 | 1.92 |
| D | 20.5 | 485 | 0.144 | 2.18 |

FIGS. 3*a*–3*d* demonstrate that the temperatures of cooling elements B, C and D were lower at all cooling water flow rates than the reference measurements taken from cooling element A. However, since the flow cross-sections of the said test pieces had to be made with different dimensions for technical manufacturing reasons, the efficiency of the heat transfer cannot be compared directly from the results in FIGS. 3*a*–3*d*. Therefore the test results were normalised as follows:

Stationary heat transfer between two points can be written:

$$Q=S\times\lambda\times(T_1-T_2),$$

where

Q=amount of heat transferred between the points [W]

S=shape factor (dependent on the geometry) [m]

λ=thermal conductivity of the medium [W/mK]

$T_1$=temperature of point 1 [K]

$T_2$=temperature of point 2 [K]

Applying the above equation to the test results, the following quantities are obtained:

Q=measured thermal power transferred to cooling water

λ=thermal conductivity of copper [W/mK]

$T_1$=temperature at bottom of element as calculated from tests [K]

$T_2$=temperature of water channel wall as calculated from tests [K]

S=shape factor for a finite cylinder buried in a semi-infinite medium (length L, diameter D) shape factor can be determined according to the equation $$S=2\pi L/\ln(4z/D)$$

when Z>1.5D, z=depth of immersion measured from the centre line of the cylinder [m]

Figure 4:
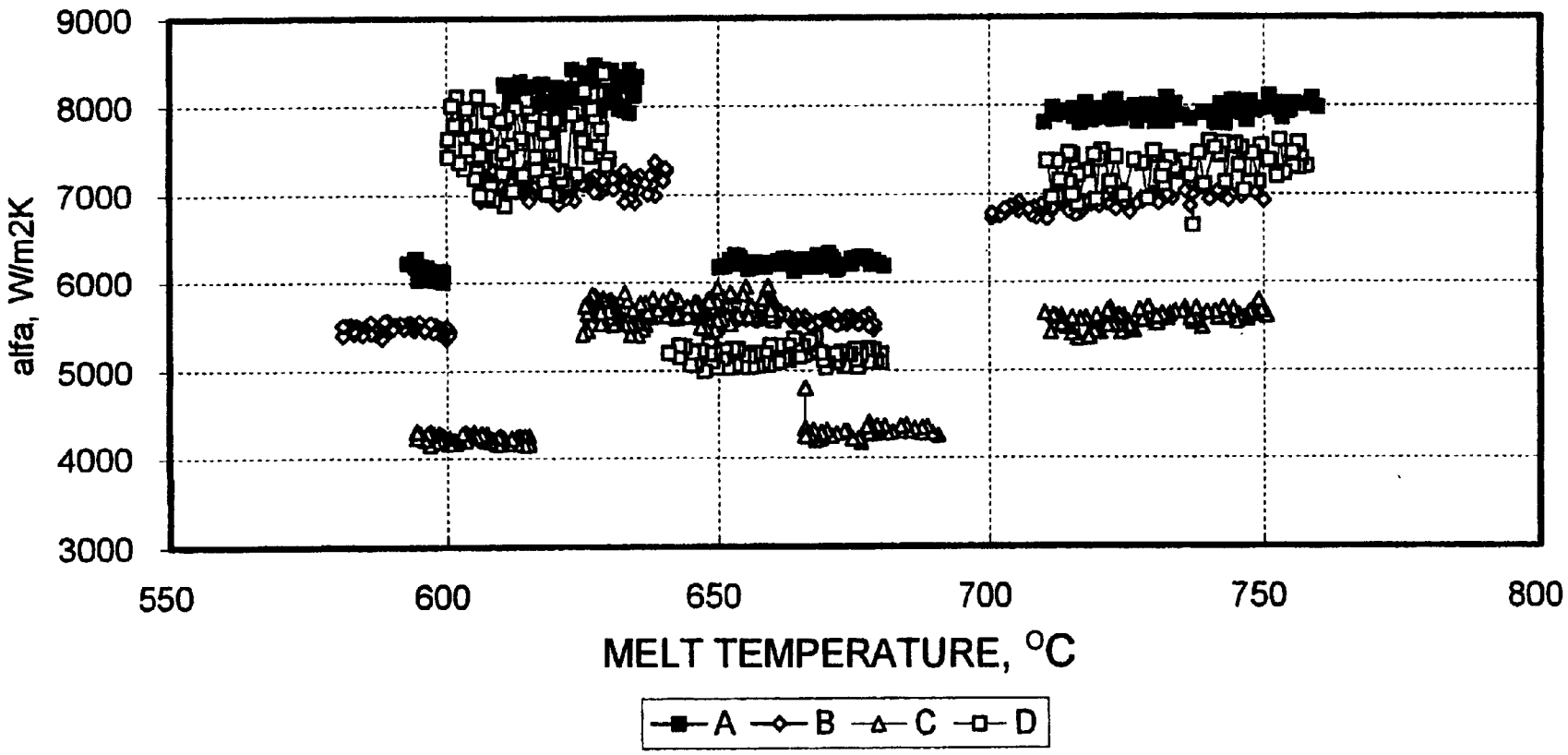
FIG. 4 presents the heat transfer coefficient calculated from the measurements taken as a function of the melt.

The heat transfer coefficients determined in the above way are presented in FIG. 4. According to multivariate analysis a very good correlation is obtained between the heat transfer coefficient and the water flow rate as well as the amount of heat transferred to the water. The regression equation heat transfer coefficients for each cooling element are presented in Table 2.

Thus a $[W/m^2K]=c+a\times v\ [m/s]+b\times Q[kW]$.

TABLE 2

| | C | A | b | $r^2$ |
|---|---|---|---|---|
| A | 4078.6 | 1478.1 | 110.1 | 0.99 |
| B | 3865.8 | 1287.2 | 91.6 | 0.99 |
| C | 2448.9 | 1402.1 | 151.2 | 0.99 |
| D | 2056.5 | 2612.6 | 179.7 | 0.96 |

To make the results comparable, the cross-section areas of the flow channels were normalized so that the amount of water flow corresponds to the same flow rate. The flow channel dimensions and heat transfer surface areas normalized according to the flow amount and rate are presented in Table 3. Using the dimensions given in Table 3 for cases A', B', C' and D' and the heat transfer coefficients determined as above, the temperature difference of the wall and water for normalized cases regarding the flow amount were calculated as a function of water flow rate for 5, 10, 20 and 30 kW heat amounts with the equation $$\Delta T=Q/(\alpha\times A)$$

TABLE 3

| | Diameter mm | Flow cross-sectional area $mm^2$ | Heat transfer surface/1 m $m^2$/1 m | Relative heat transfer surface area |
|---|---|---|---|---|
| A* | 21.0 | 346 | 0.066 | 1.00 |
| B* | 21.0 | 346 | 0.087 | 1.32 |
| C* | 19.2 | 346 | 0.120 | 1.82 |
| D* | 15.7 | 346 | 0.129 | 1.95 |

Figure 5:
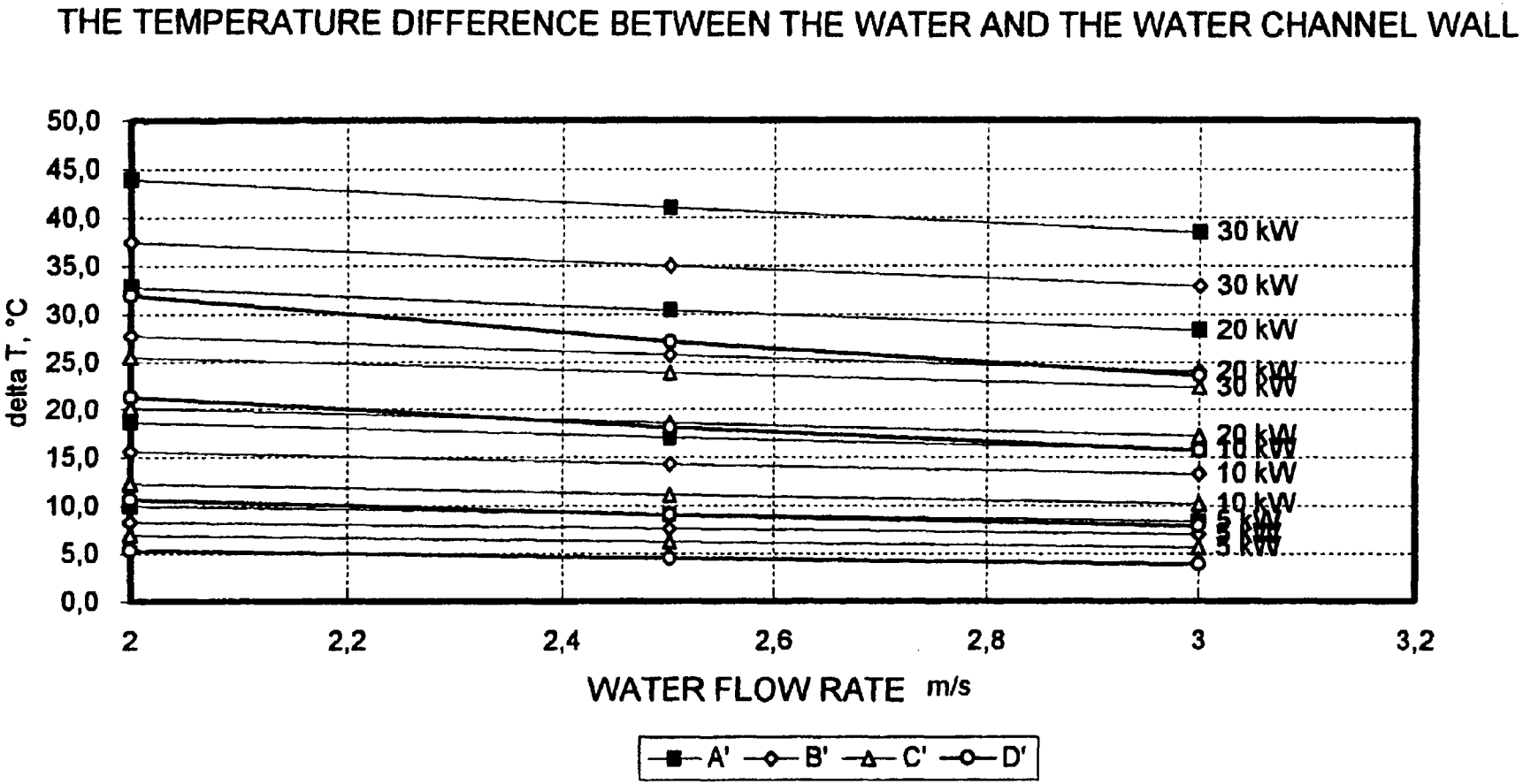
FIG. 5 presents the differences in temperature of the cooling water and the channel wall at different cooling levels for normalized cooling elements.

The results are shown in FIG. 5. The figure shows that all the cooling elements manufactured according to this invention achieve a certain amount of heat transfer with a smaller temperature difference between the water and the cooling channel wall, which illustrates the effectiveness of the method. For example, at a cooling power of 30 kW and water flow rate of 3 m/s, the temperature difference between the wall and water in different cases is:

| | ΔT [K] | Relative ΔT [%] |
|---|---|---|
| A' | 38 | 100 |
| B' | 33 | 85 |
| C' | 22 | 58 |
| D' | 24 | 61 |

When the results are compared with the heat transfer surfaces, it is found that the temperature difference between the wall and the water needed to transfer the same amount of heat is inversely proportional to the relative heat transfer surface. This means that the changes in surface area described in this invention can significantly influence the efficiency of heat transfer.

What is claimed is:

1. A method for enhancing the heat transfer capability of a pyrometallurgical reactor cooling element with a cooling water flow channel, fabricated of highly thermal conductive metal, comprising: forming the cooling element of a wrought copper plate; machining into the cooling element at least one cooling water flow channel comprised of a plurality of straight channel parts, at least one of said flow channel parts being transverse to another of said flow channel parts, each of said flow channel parts being essentially round in cross-section; and subsequently machining threads or rifle-like grooves on the inner surface of each flow channel part to increase the wall surface area of the flow channel part inside the cooling element without increasing the diameter or length of each flow channel.

2. The method according to claim 1, wherein said cooling water flow channel is machined to form a U shape, said U-shape being formed by three cooling water flow channel parts, a first and a second of said cooling water flow channel parts being machined so that they are substantially parallel to one another and a third of said cooling water flow channel parts being machined so that it is substantially transverse to the first and second cooling water flow channel parts, said first, second and third water flow channel parts being in fluid communication with one another.

3. The method according to claim 2, further comprising inserting a plug into an end of at least one of said first, second and third cooling water flow channel parts to place the first, second and third cooling water flow channel parts in fluid communication with one another and to form said cooling water flow channel.

4. A method for enhancing the heat transfer capability of a pyrometallurgical reactor cooling element with a cooling water flow channel, fabricated of highly thermal conductive metal, comprising forming the cooling element of a wrought copper plate; machining at least one cooling water flow channel that is essentially round in cross-section into the cooling element; and subsequently machining threads or rifle-like grooves on the inner surface of the flow channel to increase the wall surface area of the flow channel inside the cooling element without increasing the diameter or length of the flow channel.

5. The method according to claims 4, wherein the rifle-like grooves are made by means of an expanding mandrel.

* * * * *